US008291993B2

(12) United States Patent
Juncker

(10) Patent No.: US 8,291,993 B2
(45) **Date of Patent: *Oct. 23, 2012**

(54) SOIL STABILIZER WITH TRACK APPARATUS

(75) Inventor: Kenneth J. Juncker, Mt. Vernon, IN (US)

(73) Assignee: ATI, Inc., Mt. Vernon, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/640,789

(22) Filed: Dec. 18, 2006

(65) Prior Publication Data

US 2007/0102173 A1 May 10, 2007

Related U.S. Application Data

(63) Continuation of application No. 10/730,574, filed on Dec. 8, 2003, now Pat. No. 7,156,185.

(51) Int. Cl.
*A01B 33/00* (2006.01)

(52) U.S. Cl. ..... 172/80; 305/135; 180/9.21

(58) Field of Classification Search ..... 172/80, 172/123; 180/900, 9.1, 9.21, 9.3, 9.26, 9.46; 305/120, 122, 127, 131, 135, 143, 148
See application file for complete search history.

(56) References Cited

U.S. PATENT DOCUMENTS

| | | | | | |
|---|---|---|---|---|---|
| 3,746,101 | A | | 7/1973 | Takata | |
| 3,774,708 | A | * | 11/1973 | Purcell et al. | 180/9.5 |
| 4,227,748 | A | * | 10/1980 | Meisel, Jr. | 305/144 |
| 5,074,025 | A | | 12/1991 | Willard, III | |
| 5,316,381 | A | * | 5/1994 | Isaacson et al. | 305/145 |
| 5,373,902 | A | | 12/1994 | Lindblom | |
| 5,829,848 | A | | 11/1998 | Kelderman | |
| 5,842,757 | A | | 12/1998 | Kelderman | |
| RE36,284 | E | | 8/1999 | Kelderman | |
| 5,984,436 | A | * | 11/1999 | Hall | 305/145 |
| 6,024,183 | A | * | 2/2000 | Dietz et al. | 180/9.1 |
| D425,526 | S | | 5/2000 | Juncker et al. | |
| 6,062,327 | A | * | 5/2000 | Ketting et al. | 180/9.52 |
| 6,062,661 | A | | 5/2000 | Juncker et al. | |
| 6,062,662 | A | | 5/2000 | Witt | |
| 6,068,353 | A | | 5/2000 | Juncker et al. | |
| 6,074,024 | A | | 6/2000 | Juncker | |
| 6,536,854 | B2 | | 3/2003 | Juncker et al. | |
| 6,543,861 | B1 | | 4/2003 | Kahle et al. | |
| 6,543,862 | B1 | | 4/2003 | Kahle et al. | |
| 6,557,953 | B1 | | 5/2003 | Kahle et al. | |
| D488,171 | S | | 4/2004 | Juncker et al. | |
| 2002/0130552 | A1 | * | 9/2002 | Juncker et al. | 305/195 |

* cited by examiner

*Primary Examiner* — Jamie L McGowan
(74) *Attorney, Agent, or Firm* — Jansson Shupe & Munger Ltd.

(57) ABSTRACT

A soil stabilizer for treating ground surface includes a stabilizer frame, a rotor rotatably mounted thereon, the rotor being movable such that the rotor may engage various depths of earth, a rotatable axle, and a track apparatus mounted on the rotatable axle, the track apparatus supporting the stabilizer frame and providing for movement of the stabilizer frame and rotor across the ground surface. The track apparatus may include a continuous flexible track having an upper length and a ground-engaging lower length and including an inner surface, an axle wheel mountable to the rotatable axle for rotational movement therewith, the axle wheel engaging the inner surface of the flexible track along the upper length to drive the flexible track in response to rotation of the axle, and a track apparatus frame for mounting the axle wheel.

17 Claims, 11 Drawing Sheets

SOIL STABILIZER WITH TRACK APPARATUS

RELATED APPLICATION

This application is a continuation of patent application Ser. No. 10/730,574, filed Dec. 8, 2003, being issued as U.S. Pat. No. 7,156,185 on Jan. 2, 2007. The contents of the parent application are incorporated herein.

FIELD OF THE INVENTION

This invention relates generally to earth working equipment. More specifically, the invention pertains to soil stabilizing devices used to treat soil to either improve stability of subsurface layers of earth, control movement of subsurface water or both.

BACKGROUND OF THE INVENTION

In the construction industry, the need for manipulating soil and other bases for construction is frequently encountered. This need typically occurs in the construction of buildings, paved roads and parking lots and other improvements. Often, the surface upon which a structure will be constructed has insufficient stability such that it will collapse during construction or some time thereafter. In order to strengthen the ground surface, the ground surface is treated with lime, concrete or other additives. Such treatment is typically performed at a depth of sixteen inches from the ground surface. If the ground is wet, the earth typically requires multiple treatments at four inch intervals. Such treatment usually dries the ground and makes it sufficiently hard to serve as a base for construction.

In order to provide such treatment, soil stabilizers of various designs have been used. Typically, soil stabilizers include a drum portion supported by four wheels. The drum portion houses a rotor which cuts the earth and causes the earth under the drum portion to be mixed with lime, concrete and/or other additives. The treated earth then exits the area under the drum and is positioned at the desired depth.

Typical soil stabilizers weigh as much as 60,000 lbs. Such weight causes the underlying earth to undergo extreme compression. Frequently, any soft patch of earth is more greatly compressed than any neighboring hard-packed earth. Such differences in compression can cause ruts which impact the wheels of the soil stabilizing vehicles. The wheels transfer the impact force to the vehicles and cause the vehicles to experience bounce, in which the weight of the vehicles is transferred up and down as the vehicles move along. The bounce of the vehicles, in turn, causes the rotor to be moved up and down and to cut the earth at varying depths. Under these circumstances, the depth of a cut cannot be guaranteed by making a single pass over an area of ground. Therefore, operators often make several passes with the rotor positioned deeper than necessary in order to ensure that soil at a lesser depth is properly treated. For instance, for treatment at a depth of eleven inches, an operator may drive a soil stabilizer over an area of ground three times with the rotor positioned twenty inches deep. Such treatment is not efficient use of labor, materials or fuel.

Furthermore, soil stabilizers often encounter difficult conditions in which traction is poor and the bottom edge encounters substantial resistance. In such conditions, the stabilizer operator may not be able to get the stabilizer to move forward to make the desired cut. It is known in the field that operators may "wiggle" the wheels side to side or otherwise encourage the stabilizer's wheels to obtain better traction to allow forward movement. Such wiggling frequently causes the stabilizer to bounce which further impairs the ability to obtain a cut and soil treatment at the appropriate depth. Another way to overcome the inability to move forward, is for the operator to make a cut at a shallower depth. Of course, treatment at a shallower depth may not provide sufficient soil stability and may lead to construction problems.

Another problem is frequently encountered by soil stabilizers which are used on hill sides or other uneven terrain, typically in cases where the soil treatment is intended to control movement of water. Often soil stabilizers employed in such use slide down the hillside or even roll over during operation. Sliding is typically caused by the poor traction of the soil stabilizer's wheels. Rolling over usually occurs when the uphill wheel of the soil stabilizer encounters a bump or rut which causes the uphill tire to bounce. The upward shift in weight causes the center of gravity to shift upward and results in the soil stabilizer rolling over.

Another problem faced by soil stabilizers is the compaction of earth under the soil stabilizer wheels in the direction of travel. This problem is aggravated when working in wet areas where a soil stabilizer may sink into the earth on its first pass across a path, resulting in a large delay in completing the job. Therefore, the resistance to sinking into soil, or flotation, would be highly desirable for a soil stabilizer.

As can be seen, regardless of the type of soil stabilizer utilized, several problems are encountered when removing and treating large amounts of earth. Therefore, in view of these problems and their consequences, there is a need in the field of earth working for an improved soil stabilizer.

OBJECTS OF THE INVENTION

It is an object of the invention to provide an improved soil stabilizer for removing and treating soil.

Another object of the invention is to provide a soil stabilizer which eliminates or reduces vibration and/or bouncing.

Another object of the invention is to provide a soil stabilizer which allows transport at higher speeds over smooth or uneven terrain.

Another object of the invention is to provide a soil stabilizer which does not cause rutting on smooth or uneven roads.

Another object of the invention is to provide a soil stabilizer which provides for reduced stress on soil stabilizer components.

Another object of the invention is to provide a soil stabilizer which allows for superior depth control allowing for treatment at a desired depth on a single pass.

Another object of the invention is to provide a soil stabilizer which has a lower center of gravity than traditional soil stabilizers.

Another object of the invention is to provide a soil stabilizer which more ably negotiates hillsides than traditional soil stabilizers.

Another object of the invention is to provide a soil stabilizer which experiences reduced compaction of the earth compared to traditional soil stabilizers.

Another object of the invention is to provide a soil stabilizer with increased traction.

Another object of the invention is to provide a soil stabilizer with a track apparatus which provides improved performance.

Another object of the invention is to provide a soil stabilizer with a track apparatus having a uni-body frame.

Another object of the invention is to provide a soil stabilizer with a track apparatus having wheels engaging a track which provide for use with a large axle wheel.

Still another object of the invention is to provide a soil stabilizer with a track apparatus with a tensioning device for maintaining tension of the continuous track.

These and other objects of the invention will be apparent from the following descriptions and from the drawings.

BRIEF SUMMARY OF THE INVENTION

In accordance with the present invention, an improved soil stabilizer for treating soil is provided. The soil stabilizer of this invention overcomes certain problems and shortcomings of the prior art, including those noted above, and provides a unique structure satisfying a number of specific needs.

In certain embodiments, the soil stabilizer for treating a ground surface comprises a stabilizer frame; a rotor rotatably mounted with respect to the stabilizer frame, the rotor including a cutting tool for cutting earth, the rotor movable with respect to the ground surface such that the rotor may engage various depths of earth; a rotatable axle for providing movement of the soil stabilizer to move the stabilizer frame and rotor across the ground surface, the axle connected with respect to the stabilizer frame; and a track apparatus mounted on the rotatable axle. The track apparatus supports the stabilizer frame, provides for movement of the stabilizer frame and rotor across the ground surface and includes a continuous flexible track having an upper length and a ground-engaging lower length and including an inner surface; an axle wheel mountable to the rotatable axle for rotational movement therewith, the axle wheel engaging the inner surface of the flexible track along the upper length to drive the flexible track in response to rotation of the axle; and a track apparatus frame for mounting the axle wheel.

In certain embodiments, the rotatable axle is powered to provide movement of the soil stabilizer. The soil stabilizer may further comprise a mixing chamber, the rotor pulling soil into the chamber where the soil is treated. The mixing chamber may include a rear exit through which soil passes after the soil is treated. The mixing chamber may include a bottom surface which engages the ground surface, the bottom surface including an opening through which the rotor passes when the rotor is lowered into contact with the earth.

In certain embodiments, the rotatable axle is a front rotatable axle and the track apparatus is a front track apparatus and the soil stabilizer further comprises a rear rotatable axle connected with respect to the stabilizer frame and a rear track apparatus mounted on the rear rotatable axle, the rear track apparatus supporting the stabilizer frame and providing for movement of the stabilizer frame and rotor across the ground surface.

Such a rear track apparatus may include a continuous flexible track having an upper length and a ground-engaging lower length and including an inner surface, an axle wheel mountable to the rotatable axle for rotational movement therewith, the axle wheel engaging the inner surface of the flexible track along the upper length to drive the flexible track in response to rotation of the axle, and an apparatus frame for mounting the axle wheel.

The rotatable axle may include two axially aligned rotatable axles and the track apparatus may include two track apparatus with each track apparatus mounted on a respective rotatable axle. Each such track apparatus may include a continuous flexible track having an upper length and a ground-engaging lower length and including an inner surface, an axle wheel mountable to the rotatable axle for rotational movement therewith, the axle wheel engaging the inner surface of the flexible track along the upper length to drive the flexible track in response to rotation of the axle, and an apparatus frame for mounting the axle wheel.

In certain embodiments the aforementioned rotatable axles are front rotatable axles, the pair of track apparatus are front track apparatus and the soil stabilizer further comprises a rear rotatable axle connected with respect to the stabilizer frame and a rear track apparatus mounted on the rear rotatable axle, the rear track apparatus supporting the stabilizer frame and providing for movement of the stabilizer frame and rotor across the ground surface. The rear track apparatus may include a continuous flexible track having an upper length and a ground-engaging lower length and including an inner surface, an axle wheel mountable to the rotatable axle for rotational movement therewith, the axle wheel engaging the inner surface of the flexible track along the upper length to drive the flexible track in response to rotation of the axle, and an apparatus frame for mounting the axle wheel. In such embodiments, the front and rear rotatable axles may be powered to provide movement of the soil stabilizer.

The rear rotatable axle may include two axially aligned rear rotatable axles and the rear track apparatus may include two rear track apparatus with each rear track apparatus mounted on a respective rear rotatable axle. Each rear track apparatus may include a continuous flexible track having an upper length and a ground-engaging lower length and including an inner surface, an axle wheel mountable to the rotatable axle for rotational movement therewith, the axle wheel engaging the inner surface of the flexible track along the upper length to drive the flexible track in response to rotation of the axle, and an apparatus frame for mounting the axle wheel.

In certain embodiments, the track apparatus further includes a plurality of wheels engaging the inner surface of the track, including leading and trailing idler wheels, and at least one bogie wheel engaging only a middle portion of the lower length of the track. In such embodiments, the frame is of a uni-body construction such that it includes fixed-mounts in fixed relative positions, each fixed-mount defining an axis, the axle wheel is rotatably mounted to one of the fixed-mounts and turns on the respective fixed-mount axis, one of the idler wheels is rotatably mounted to one of the fixed-mounts and turns on the respective fixed-mount axis, the at least one bogie wheel is rotatably mounted to one of the fixed-mounts and turns on the respective fixed-mount axis, and an idler-mounting bracket is pivotably mounted to another of the fixed-mounts and pivots on the respective fixed-mount axis, the bracket having an idler-mount defining an idler-mount axis at which the other idler wheel is rotatably mounted in variable positions with respect to the frame. The frame may define a lateral recess receiving the axle wheel and may include a spindle hub for rotatably receiving the rotatable axle. The fixed-mounts may comprise apertures for receiving axles therethrough.

In such embodiments, the trailing idler wheel may be rotatably mounted to one of the fixed-mounts and the leading idler wheel may be rotatably mounted to the idler-mount. The trailing idler wheel may comprise a pair of axially-aligned wheels and the leading idler wheel may comprise a pair of axially-aligned wheels. The track apparatus may further comprise a leading idler assembly attached to the frame at one of the fixed mounts with the leading idler assembly including the leading idler wheel engaging the flexible track.

In certain embodiments, the track apparatus further comprises an idler assembly having an idler wheel engaging the track, the idler assembly being moveable with respect to the apparatus frame, and a tensioning device for maintaining tension on the continuous flexible track. The tensioning device may comprise a main-cylinder housing interconnected to one of the frame and the idler assembly, the housing extending along an axis and defining a main chamber therein, a main piston having a first end operatively connected to the other of the frame and the idler assembly and a second end slidably received within the chamber, the piston movable between a retracted position and an extended position, a primary dampening structure for resisting movement of the piston toward the retracted position for a first predetermined axial length, and a secondary dampening structure for resisting movement of the piston toward the retracted position for a further axial length beyond the first predetermined axial length, the secondary dampening structure resisting movement of the piston independent of the primary dampening structure.

The primary dampening structure may include a primary cylinder extending along an axis and defining a primary chamber therein, and a primary piston slidably received in the primary cylinder and movable axially between a first and second position, the primary piston dividing the primary chamber into a first portion for receiving a pressurized gas and a second portion.

The secondary dampening structure may include a secondary cylinder extending along an axis and defining a secondary chamber therein, and a secondary piston slidably received in the secondary cylinder and movable axially between a first and second position, the secondary piston dividing the secondary chamber into a first portion for receiving a pressurized gas and a second portion; whereby the conduit interconnects the main chamber and the second portion of the secondary chamber and wherein the hydraulic fluid is disposed within the second portion of the secondary chamber. In certain embodiments, the pressure of the pressurized gas in the first portion of the secondary chamber is greater than the pressure of the pressurized gas in the first portion of the primary chamber. The primary and secondary dampening structures may operate to progressively increase resistance to movement of the idler wheel toward the deflected position as the idler wheel moves toward the deflected position.

In certain embodiments, the flexible track includes spaced lugs projecting from the inner surface, each lug terminating in a distal surface spaced inwardly from the main inner surface, and the axle wheel comprises a central hub portion mountable on the axle for rotational movement therewith, a radially-extending portion terminating in a circumferential edge, and a peripheral portion affixed to the circumferential edge and having outwardly-facing lug-engagement surfaces positioned for engagement with the distal surfaces of the track lugs. The peripheral portion may include an outer rim forming the outwardly-facing lug-engaging surfaces and the outer rim may include a plurality of spaced openings therein. In certain embodiments, the peripheral portion includes peripherally-spaced cross-members affixed to the circumferential edge and forming the outwardly-facing lug-engaging surfaces.

In certain embodiments, the axle wheel is substantially free of side structure in positions laterally adjacent to the lug-engagement surfaces and radially beyond the circumferential edge, whereby the track lugs are free to adjust their precise positions of engagement with the lug-engagement surfaces. Such adjustment relies on the lug-engagement surfaces having sufficient width (in the axial direction), such as at least half the width of the track lugs, or at least 75% the width of the track lugs, or at least the same width as the track lugs. Each lug-engagement surface may extend in an axial direction parallel to the drive axis such that each lug-engagement surface is a portion of a cylinder. The outwardly-facing lug-engagement surfaces may be substantially convex or substantially planar.

The peripheral portion affixed to the circumferential edge may have radially-projecting drive members defining lug-receiving gaps therebetween with the outwardly-facing lug-engagement surfaces within the lug-receiving gaps in position for engagement with the distal surfaces of the track lugs. In such embodiments, the axle wheel may be substantially free of side structure in positions which are laterally adjacent to the lug-engagement surfaces between adjacent pairs of the drive members and radially beyond the circumferential edge, whereby the track lugs are free to adjust their precise positions of engagement with the lug-engagement surfaces. The peripheral portion may include a plurality of spaced openings for allowing debris to pass through the peripheral portion.

The axle wheel may be substantially free of side structure in positions which are laterally adjacent to the lug-engagement surfaces between adjacent pairs of the drive members and radially beyond the circumferential edge such that the track lugs are free to adjust their precise positions of engagement with the lug-engagement surfaces.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment. In the drawings.

DETAILED DESCRIPTION OF PREFERRED EMBODIMENTS

Prior track apparatus for vehicles are disclosed in U.S. Pat. No. Re36,284 (Kelderman), U.S. Pat. No. 5,829,848 (Kelderman), U.S. Pat. No. 6,536,854 (Kahle et al.), U.S. Pat. No. 6,543,861 (Kahle et al.), U.S. Pat. No. 6,543,862 (Kahle et al.) and U.S. Pat. No. 6,557,953 (Kahle et al.), assigned to the assignee of the present invention, and are incorporated herein by reference.

Figure 1:
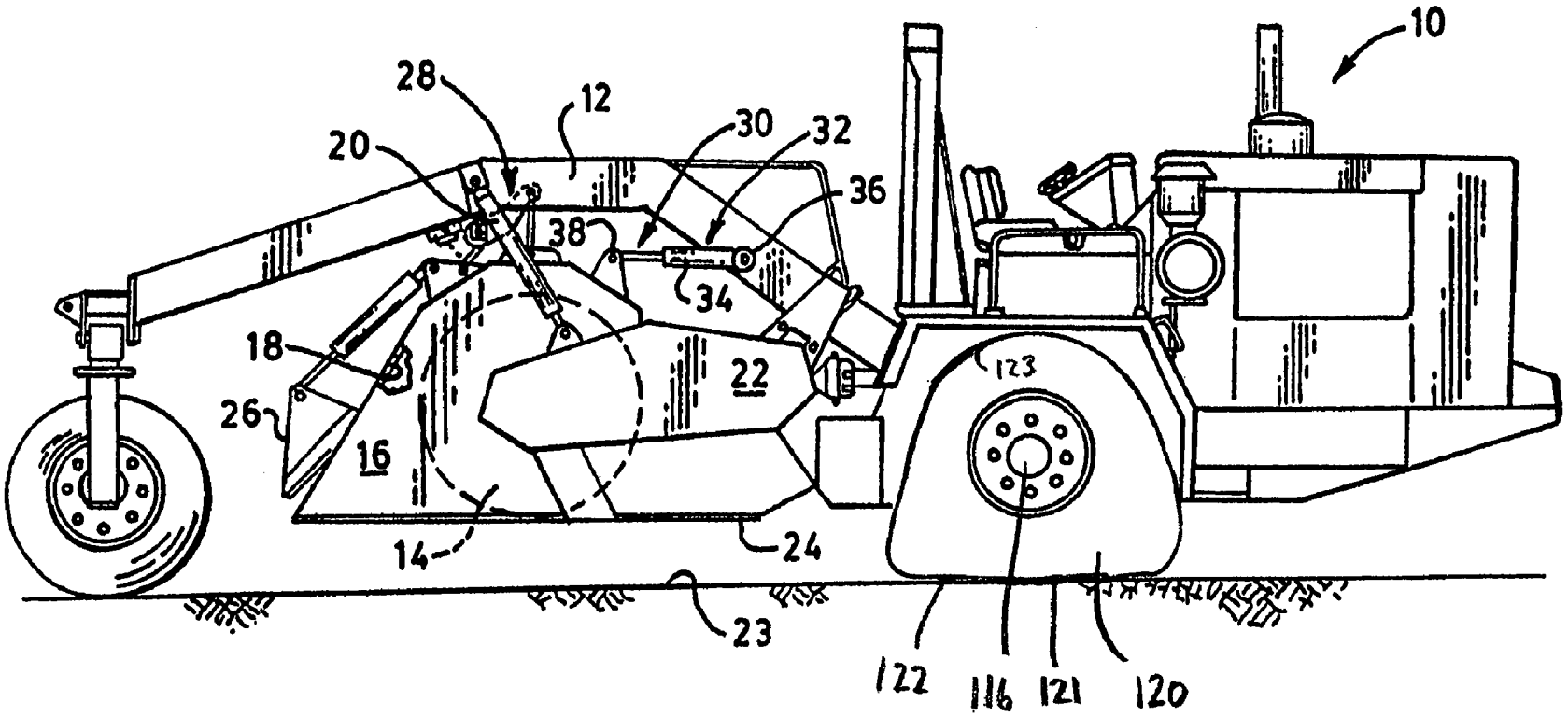
FIG. 1 is a side view of a soil stabilizer embodying the present invention, with the front wheels converted to utilize track apparatus.

Referring to FIG. 1, a soil stabilizer in accordance with the present invention is generally designated by the reference numeral 10. Soil stabilizer 10 includes a frame 12, a horizontally disposed and vertically adjustable rotor 14 having ground engaging tools mounted thereon, and a hood member 16 that forms an open bottom mixing chamber 18 about the rotor 14.

A pair of hydraulic lift cylinders 20, disposed on opposed sides of the hood member 16, connect a pair of similarly disposed rotor drive cases 22 to the frame 12 and controllably position the rotor 14 vertically with respect to a ground surface 23 supporting the machine 10. Hence, the depth of ground penetration of the ground engaging tools mounted on the rotor is controlled by retraction or extension of the hydraulic cylinders 20. Typically, the hood member 16 is provided with a wear resistant surface or skid on at least a portion of a bottom, ground-contacting surface 24 that extends around the lower peripheral portion of the hood member.

In order to form an effective enclosure about the rotor 14 when excavating or mixing materials, it is desirable that the bottom surface 24 of the hood member 16 be movable to a position at which bottom surface 24 is in substantial contact with the ground surface 23.

A portion of the weight of the hood member 16 is supported by a hood support assembly 28 when bottom surface 24 contacts ground surface 23. The hood support assembly 28 is carried on the frame 12 and is adjustably connected to the hood member 16. The hood member 16 is moveable to a raised position, shown in FIG. 1, in response to retraction of the hydraulic lift cylinders 20. It is desirable, when the machine is moving with the hood member 16 in the raised position, that the bottom surface 24 of the hood member be maintained in a substantially parallel relationship with the ground surface 23.

Typically, hood assembly 30 includes hood member 16, rear gate 26 and a stabilizing link 32. The stabilizing link 32 is desirably oriented along the longitudinal axis of the soil stabilizer 10 and is pivotably connected at one end to the frame 12 and at the other end to the hood member 16. The stabilizing link 32 forms, in cooperation with the frame 12, the rotor drive cases 22 and a portion of the hood member 16. Typically, the link is of a structure that maintains the bottom surface 24 of the hood member 16 in a parallel relationship with the ground 23 during normal cutting operations or during travel. Rear gate 26 strikes-off the mixed material exiting the rear of the hood member 6.

The stabilizing link 32 preferably has a selectively variable length, such as a hydraulic cylinder 34. Desirably, the hydraulic cylinder 34 is a double acting cylinder having a head or fixed end 36 pivotably attached to the frame 12, and an extendable or movable rod end 38 pivotably connected to the hood member 16. It is also desirable that the piston disposed within the cylinder have a greater cross-sectional area on the head end side than on the rod end side. Movement of the rod end 38 is controlled by a 3-way valve having extended and retracted positions that selectively direct a flow of pressurized fluid to a corresponding side of the internal piston, and a central float position at which both sides of the piston are in fluid communication.

Machines of this type are conventionally used to stabilize soil and mix additive materials with soil or reclaimed roadway materials.

In the invention, a typical soil stabilizer, having wheels mounted on an axle, is converted for use with track apparatus. As shown in FIG. 1, soil stabilizer 10 has had its forward wheels removed and track apparatus 120 mounted on each side of rotatable axle 116. Track apparatus 120 includes flexible track 122 which has an upper length 123 and lower length 121 for engaging the ground. Flexible track 122 includes an inner surface 124. As shown in FIG. 1, rotatable axle 116 and track apparatus 120 are positioned at the forward end of soil stabilizer 10. As with typical soil stabilizers, rotor 14 is lowered to a depth and soil stabilizer 10 is propelled forward such that rotor 14 cuts ground surface 23 thereby removing earth. The earth is treated before being released at rear gate 26, such treatment typically includes mixing with lime, concrete or other additives within chamber 18.

Track 122 provides for substantially more contact with the ground surface than conventional wheels. For instance, for a thirty inch track, track 122 has three and a half times more contact with the ground than a conventional track. Likewise, for a thirty-six inch track, track 122 has nine to ten times more contact with the ground that a conventional track.

Track apparatus 120 provides for reduced vibration and/or bouncing of soil stabilizer 10. Since vibration of soil stabilizers can lead to shortened working life of machine components, the reduction of vibration lessens the need for maintenance and lengthens the working life of stabilizer components.

Soil stabilizers are preferably propelled at 10-15 mph when traveling and are preferably propelled at slower speeds when stabilizing a ground surface. Soil stabilizer 10 can be driven at 20 mph despite uneven terrain, ruts or other factors which require typical soil stabilizers to be driven at slower speeds. Furthermore, soil stabilizer 10 has a lower center of gravity than typical soil stabilizers which facilitates use of soil stabilizer 10 on hillsides or other difficult terrain without rolling or tipping over.

The improved soil stabilizer experiences improved performance over typical wheeled stabilizers. For instance, in typical soil stabilizers, the front wheels may lose traction and spin. To overcome such loss of traction, operators typically wiggle the front wheels side-to-side which leads to bouncing of the soil stabilizer. When the bottom surface 24 bounces it cannot remove the proper amount of soil for treatment. Therefore, multiple passes are frequently required to proper prepare the soil.

In addition, for particularly deep cuts, the wheels may not provide sufficient traction no matter how the operator wiggles or otherwise stimulates the wheels. Therefore, the operator must raise the rotor such that less soil is cut and accumulated and the stabilizer is able to move forward. Of course, such an operation requires that the stabilizer pass over the earth multiple times which results in treatment of the same soil, otherwise, the earth may not be sufficiently treated and stabilized.

Figure 2:
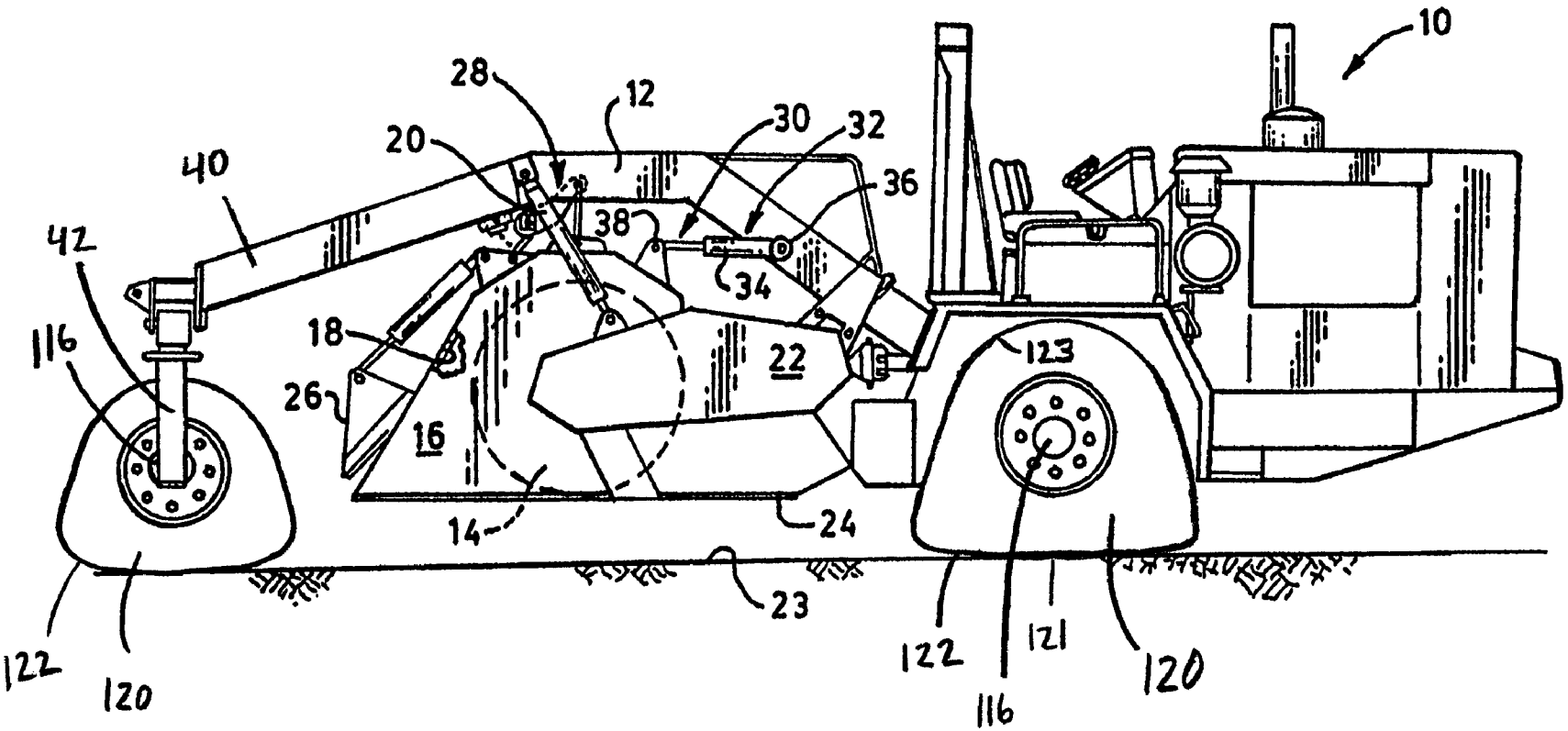
FIG. 2 is a side view of a soil stabilizer embodying the present invention, with the front and rear wheels converted to utilize track apparatus.

FIG. 2 shows a soil stabilizer 10 having its forward and rear wheels converted to track apparatus 120. As shown, rear rotatable axle 116 supported by support arms 42 depending from rear section 40 of frame 12. Rear track apparatus 120 include flexible tracks 122 which have upper lengths 123 and lower lengths 121 for engaging the ground. Flexible tracks 122 include an inner surface 124. Inclusion of four track apparatus 120 to support soil stabilizer 10 provides increased traction, increased stability and decreased vibration such that performance of the soil stabilizer 10 is improved as discussed above relative to the soil stabilizer 10 of FIG. 1.

Figure 3:
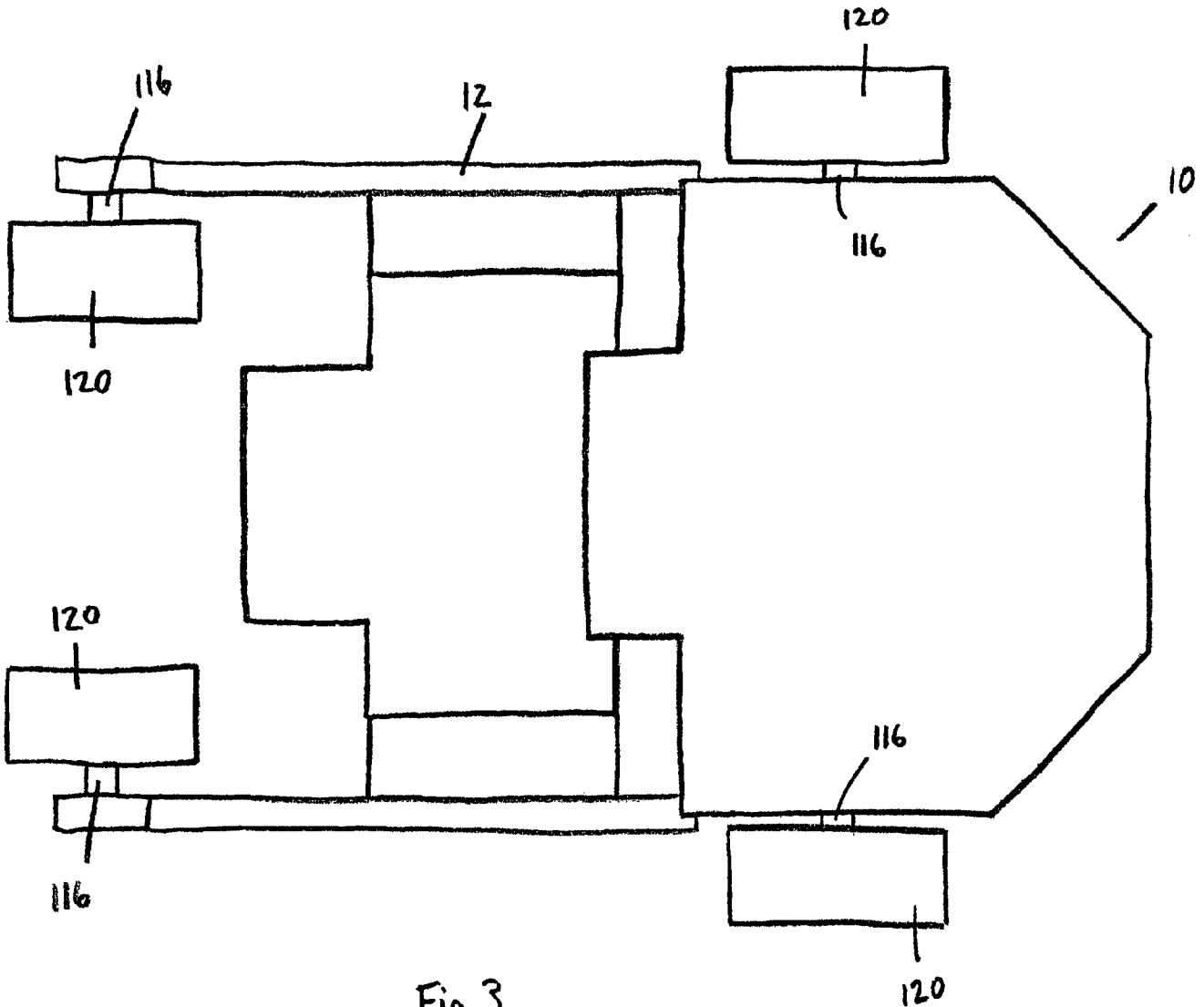
FIG. 3 is a bottom plan view of the soil stabilizer showing the attachment of track apparatus to axles in accordance with the invention.

FIG. 3 is a bottom plan view showing the attachment of track apparatus 120 to rotatable axles 116 for the soil stabilizer 10 of FIG. 2. As shown, rotatable axles 116 are connected with respect to stabilizer frame 12 such that track apparatus 120 support soil stabilizer and provide for movement. As shown, the front and rear axles may each comprise two axially aligned axles upon which a track apparatus 120 is mounted.

Figure 4:
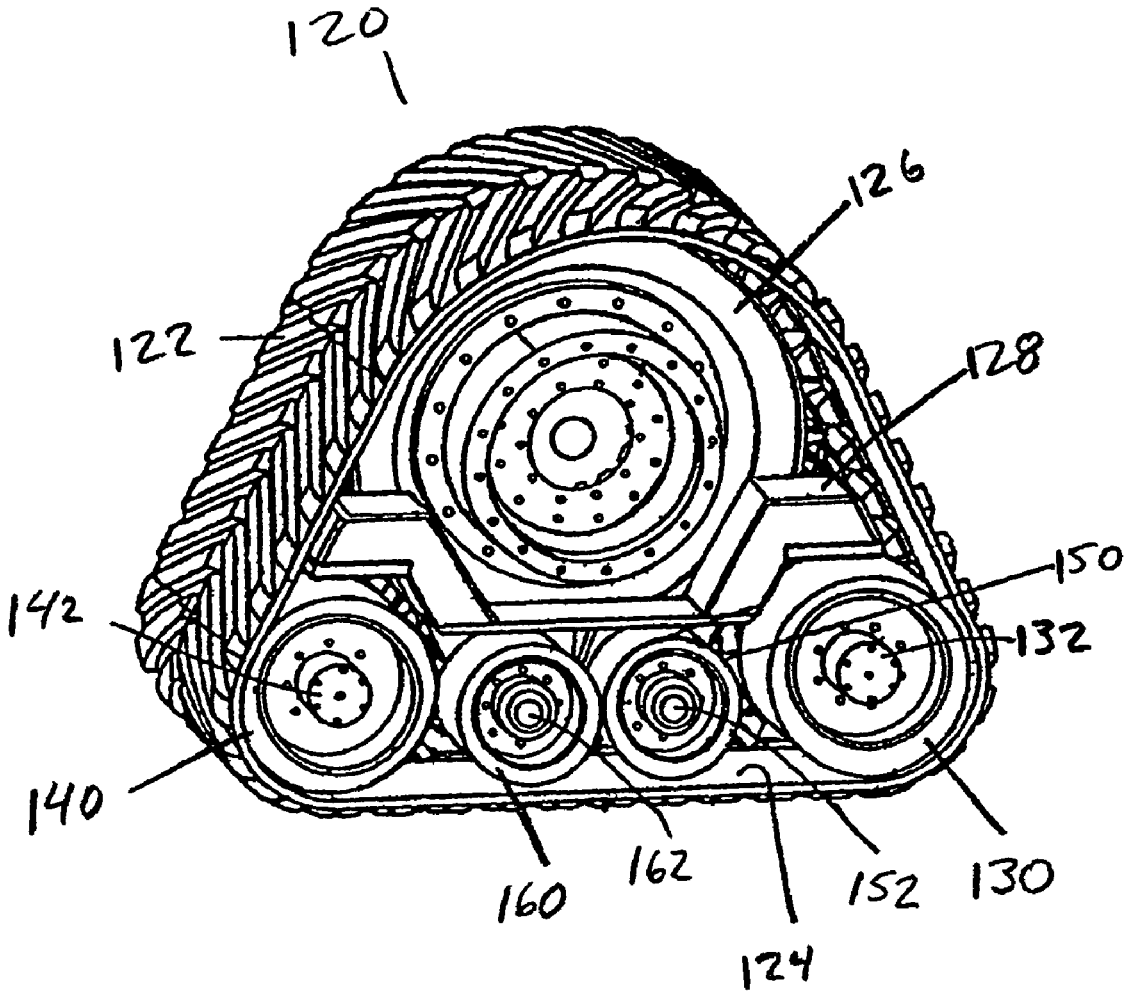
FIG. 4 is an interior isometric view of a track apparatus in accordance with the invention.

FIG. 4 shows flexible track 122 around track apparatus 120. As shown, track apparatus 120 includes frame 128 mounted about axle wheel 126. Axle wheel 126 is mountable to the rotatable axle 116 of soil stabilizer 10 for rotational movement therewith in order to drive flexible track 122. Also shown are leading idler wheel 130 mounted on leading idler axle 132, trailing idler wheel 140 mounted on trailing idler axle 142, leading bogie wheel 150 mounted on leading bogie axle 152 and trailing bogie wheel 160 mounted on trailing bogie axle 162.

Figure 5:
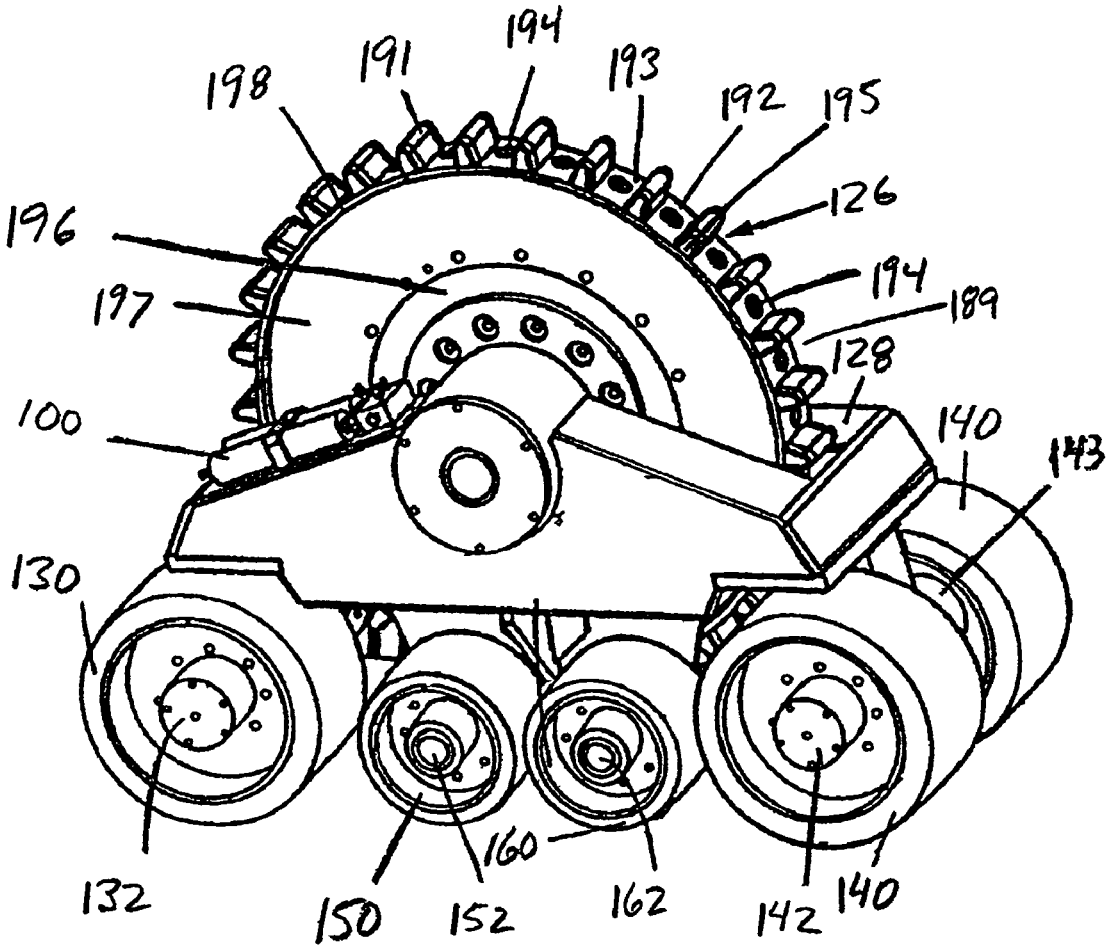
FIG. 5 is an exterior isometric view of a frame and plurality of wheels of a track apparatus in accordance with the invention.

FIG. 5 is the reverse view of FIG. 4 with track 122 removed. As shown, axle wheel 126 includes a central hub portion 196 which is mountable on rotatable axle 116 for rotation therewith. Wheel 126 further includes a radially-extending portion 197 having inner and outer surfaces. Radially-extending portion 197 of wheel 126 terminates in a circumferential edge 198 where a peripheral portion 195 of wheel 126 is affixed thereto. Peripheral portion 195 may include an outer rim 192 which is affixed (welded) to circumferential edge 198. Peripheral portion 195 or outer rim 192 preferably has sufficient width to provide support to track lugs 190 when track lugs 190 are received between drive members 191. Such width is preferably at least half the width of track lugs 190 and may have the same width as track lugs 190.

Outer rim 192 of wheel 126 includes a plurality of circumferentially spaced openings 194 therein for allowing accumulated debris to pass therethrough. Outer rim 192 includes an outer surface 193 having a plurality of circumferentially spaced drive members 191 projecting radially therefrom and defining lug-receiving gaps 189. As hereinafter described, radially-projecting drive members 191 are intended to engage corresponding track lugs 190 which project inwardly from the main inner surface 124 of flexible track 122 in order to drive flexible track 122.

In operation, track apparatus 120 is mounted to rotatable axle 116 after the conventional wheel is removed therefrom. Axle 116 may be rotated in a conventional manner through soil stabilizer 10 by an engine and through a transmission which can vary the speeds and allow for forward and reverse rotation. Flexible track 122 of track apparatus 120 is positioned over axle wheel 126 such that track lugs 190 projecting from the inner surface 124 of flexible track 122 are received between corresponding pairs of drive members 191 projecting from outer surface 193 of outer rim 192 of wheel 126. As wheel 126 rotates, drive members 191 engage corresponding track lugs 190 and drive flexible track 122 about wheel 126. Thereafter, successive drive members 191 engage subsequent track lugs 190 extending from main inner surface 124 of flexible track 122 so as to drive flexible track 122 about wheel 126.

As shown, track apparatus 120 includes a plurality of wheels including axle wheel 126, leading idler wheel 130, trailing idler wheel 140, leading bogie wheel 150 and trailing bogie wheel 160. Trailing idler wheel 140 is shown comprising a pair of axially aligned wheels separated to form a void 143 into which wheel 126 extends; however, leading idler wheel 130 and leading and trailing bogie wheels 150,160 also comprise pairs of axially aligned wheels which define voids into which wheel 126 may extend. Wheel 126 may intersect the axes defined by each pair of wheels 130,140,150,160.

Also shown is dampening mechanism 100 positioned remote from the housing and piston of the tensioning device as discussed below.

Figure 6:
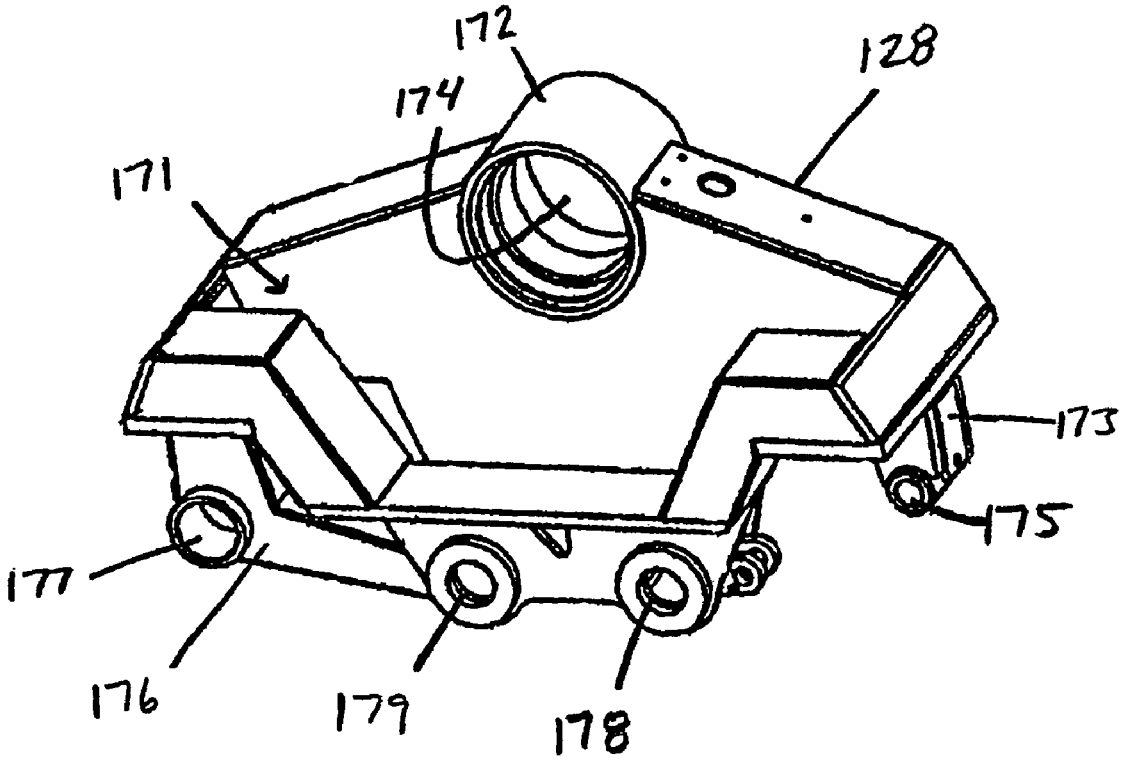
FIG. 6 is an interior isometric view of a frame of a track apparatus in accordance with the invention.

FIG. 6 shows the uni-body construction of frame 128. Frame 128 includes first and second side portions which define a wheel receipt wheel 171 therebetween for receiving wheel 126. The side portions of frame 128 are interconnected by front and rear end panels. Spindle hub 172 forms spindle hub aperture 174 which is one of several fixed-mounts on frame 128. The side panels include leading and trailing intermediate apertures 178,179, respectively, therethrough for receiving corresponding leading and trailing bogey axles 152, 162, respectively, as hereinafter described. Reinforcement elements may be mounted on the outer surface of the side panel about corresponding apertures 178,179, respectively, to reinforce apertures 178,179 and prevent deformation of the same by the bogey axles received therein. Apertures 178,179 are fixed-mounts used for mounting bogey wheels 150,160.

Frame 128 includes leading idler arm 173 and trailing idler arm 176. Leading idler arm 173 includes leading idler arm aperture 175 which is a fixed mount. Trailing idler arm 176 includes trailing idler aperture 177 which is a fixed mount.

Figure 7:
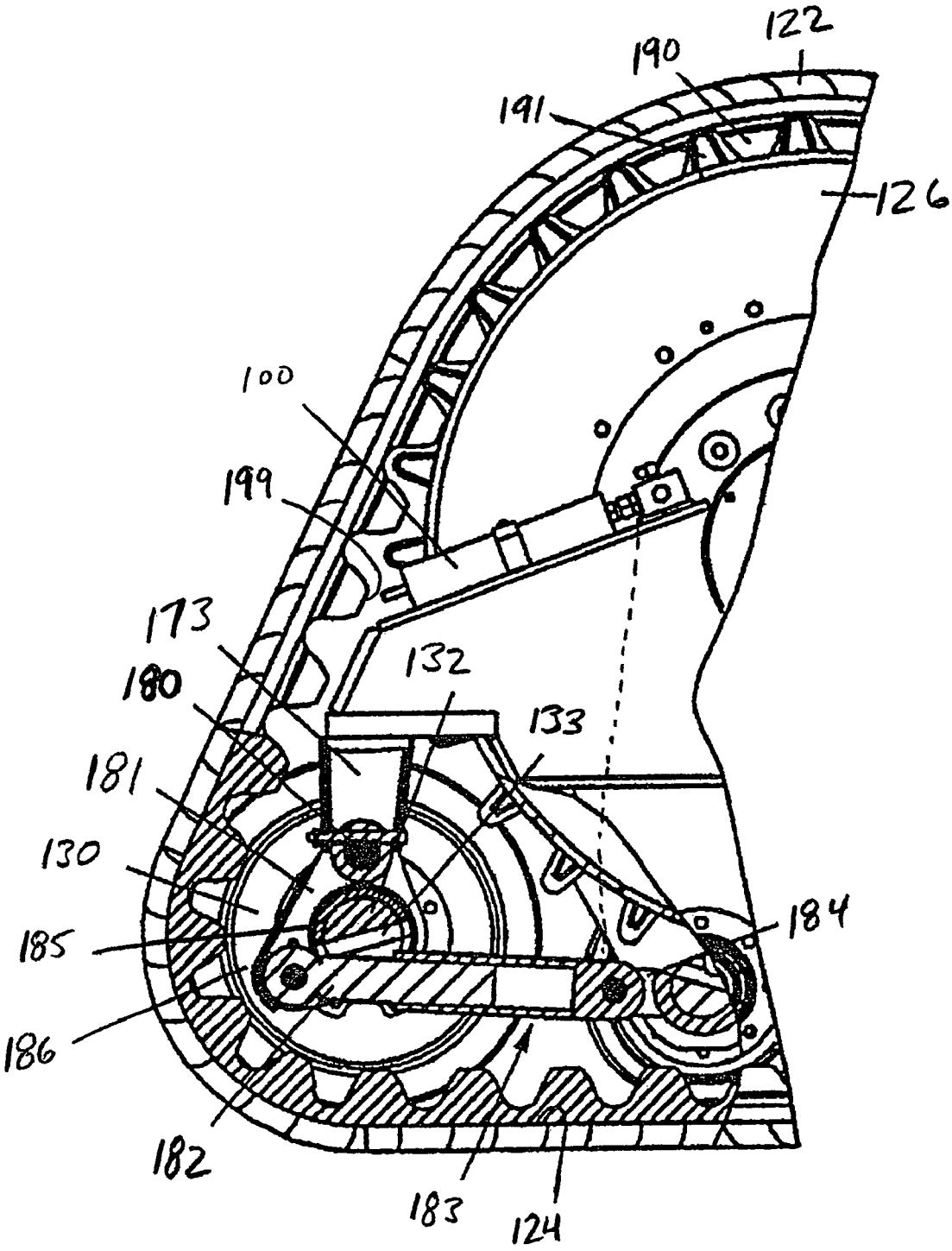
FIG. 7 is an exterior elevational view, partially in section, of a track apparatus showing the leading idler bracket and tensioning device in accordance with the invention.

FIG. 7 shows more clearly the engagement between lugs 190 and drive members 191. As shown, leading idler aperture 175 of leading idler arm 173 receives a pin 180 which is utilized to connect leading idler assembly 186 including leading idler support bracket 181 thereto. Thus, leading idler-mounting bracket 181 is pivotally mounted to leading idler support arm 173 by pivot pin 180 extending through aperture 175. Bracket 181 includes idler mount 185 for mounting leading idler wheel 130 by receiving leading idler axle 132. Leading idler axle 132 includes a notch 133 formed therein for allowing piston shaft 182 of cylinder 183 to extend therepast. As is conventional, leading idler axle 132 supports leading idler wheels 130 on opposite ends thereof.

Flexible track 122 of track apparatus 120 is positioned over wheel 126 such that track lugs 190 projecting from the inner surface 124 of flexible track 122 are received between corresponding pairs of drive members 191 projecting from outer surface 193 of outer rim 192 of wheel 126. As wheel 126 rotates drive member 131 successively engage corresponding track lugs 190 positioning tops 199 of track lugs 190 between spaced drive member 191 and drive flexible track 122 about wheel 126.

Flexible track 122 extends from wheel 126 around leading idler wheels 130, leading and trailing bogey wheels 150,160 and trailing idle wheels 140. As is apparent, flexible track 122 is in the form of a continuous loop. The aforementioned tensioning apparatus 100 serves to adjust the position of leading idler wheels 130 relative to leading aperture or fixed-mount 175, thereby allowing tension adjustment and leading idler wheel deflection in response to obstructions and other surface irregularities encountered by the soil stabilizer.

All other wheels on which track 122 is mounted, including wheel 126, trailing idler wheels 140, and leading and trailing bogey wheels 150,160, are mounted in reliably fixed positions relative to one another, on the aforementioned "fixed-mounts" of uni-body frame 128. The track apparatus frame of the invention avoids or minimizes frame distortion, and the problems related thereto.

Figure 8:
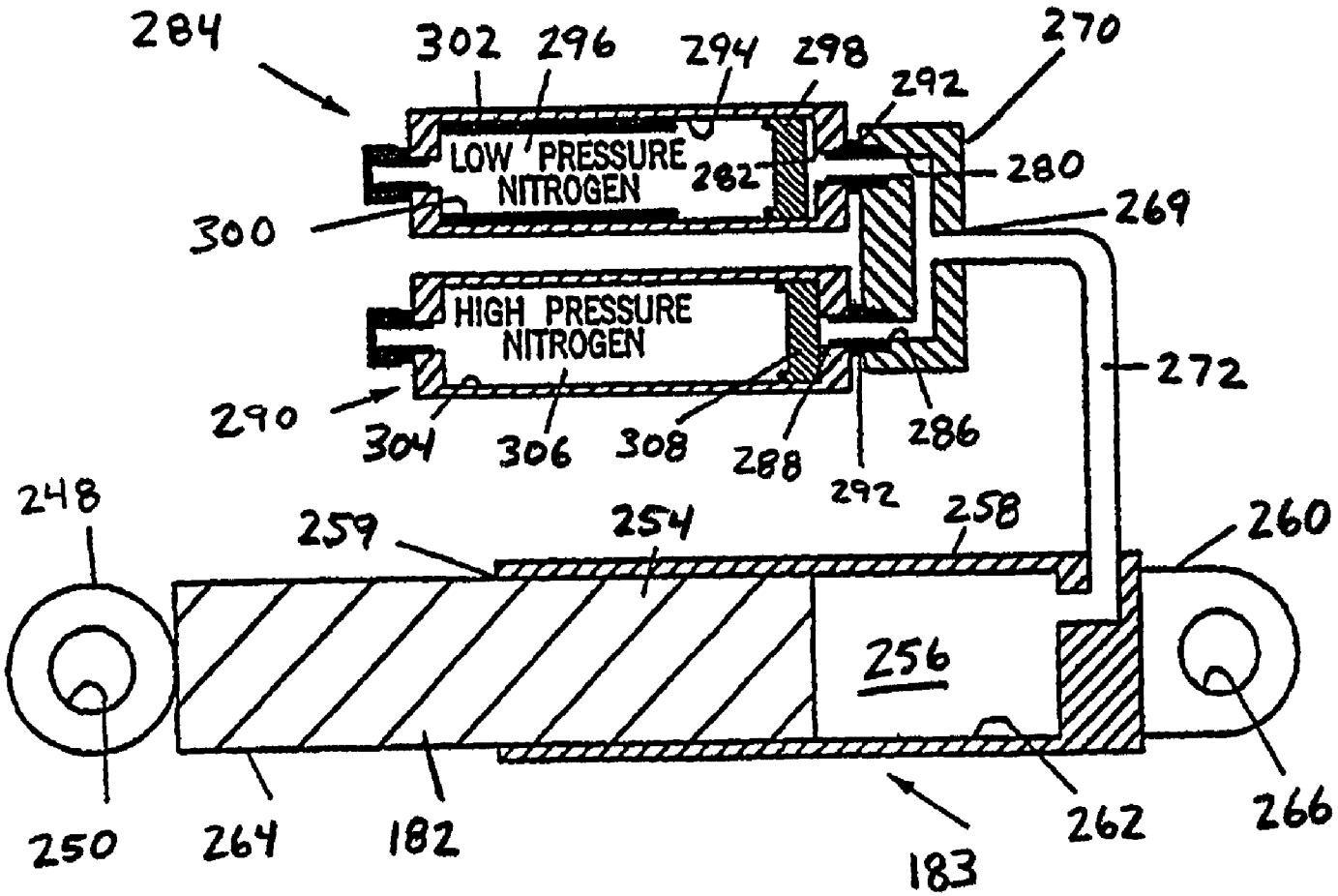
FIG. 8 is a schematic view of the tensioning device including the dampening system in accordance with the invention.

FIG. 8 details the operation of tensioning device 100. As shown, main piston shaft 182 includes a second opposite end 254 received within chamber 256 within cylinder housing 258 of cylinder 183. Cylinder housing 258 includes a first open end 259 for allowing piston shaft 182 to be inserted within main-cylinder chamber 256 and an opposite closed end 260. Inner surface 262 of cylinder housing 258 forms a slidable interface with the outer surface 264 of piston shaft 182. Closed end 260 of cylinder housing 258 includes a dog ear having an opening 266 passing therethrough. Closed end 260 of cylinder housing 258 is positioned between mounting flanges 184 such that opening 266 in closed end 260 is aligned with the openings in mounting flanges 184. Pin 180 extends through the openings in mounting flanges 184 and through opening 266 in closed end 260 of cylinder housing 258 so as to pivotally connect cylinder 183 to frame 128. Closed end 248 of cylinder housing 258 includes a connection having an opening 250 passing therethrough. Closed end 248 of cylinder housing 258 is positioned on support bracket 181 such that opening 266 in closed end 260 is aligned with a projection on support bracket 181.

Chamber 256 within cylindrical housing 258 communicates with input 269 of manifold 270 through conduit 272. In a preferred embodiment, manifold 270 is mounted to upper surface of the upper panel of frame 128. Manifold 270 includes a first output 280 operatively connected to the input 282 of low pressure cylinder 284 and a second output 286 operatively connected to the input 288 of high pressure cylinder 290. Seals 292 are provided between the outputs 280 and 286 of manifold 270 and the inputs 282 and 288 of cylinders 284 and 290, respectively, to maintain the integrity of the connections therebetween.

Primary-dampening cylinder 284 includes an inner surface 294 defining a primary-dampening chamber 296 therein. A primary-dampening piston 298 is slidably received within chamber 296 so as to divide chamber 296 into a first portion for receiving low pressure nitrogen gas therein and a second portion which communicates with chamber 256 within cylinder housing 258 through manifold 270 and conduit 272. A generally tubular limiter member 300 is positioned within chamber 296. Limiter member 300 includes an outer surface 302 which engages the inner surface 294 of cylinder 284. Limiter member 300 limits movement of piston 298 such that piston 298 is slidable between a first position and a second position.

Secondary-dampening cylinder 290 includes an inner surface 304 defining a secondary-dampening chamber 306 therein. A secondary-dampening piston 308 is slidably received within chamber 306 so as to divide chamber 306 into a first portion for receiving a high pressure nitrogen gas therein and a second portion which communicates with chamber 256 within cylinder housing 258 through manifold 270 and conduit 272. It is contemplated to provide a fluid within chamber 256 of cylinder housing 258, conduit 272, manifold 270, and second portions of chambers 296 and 306, respectively, in cylinders 284 and 290, respectively.

As main piston shaft 182 moves into main-cylinder chamber 256 of cylinder housing 258 fluid is urged from chamber 256 through conduit 272 into manifold 270. Given that the first portion of primary-dampening chamber 296 of cylinder 284 is filled with a low pressure nitrogen gas and that the first portion of secondary-dampening chamber 306 of cylinder 290 is filled with a high pressure nitrogen gas, the fluid within manifold 270 will take the path of least resistance and urge piston 298 within chamber 296 against the bias of the low-pressure nitrogen gas in first portion of chamber 296 in cylinder 284. Travel of piston 298 within chamber 296 is terminated when piston 298 engages limiter member 300, which corresponds to a predetermined distance X which piston shaft 182 is inserted into chamber 256 of cylinder housing 258. Thereafter, as piston shaft 182 is further inserted into chamber 256 of cylinder housing 258, the fluid within manifold 270 will attempt to urge piston 308 against the force of the high pressure nitrogen gas present in first portion of chamber 306 of second cylinder 290.

The amount of force necessary to insert main piston shaft 182 a predetermined distance within chamber 256 of cylinder housing 258 gradually increases from an initial value A to an increased value A' as the low pressure nitrogen gas is compressed in first portion of primary-dampening chamber 296 in cylinder 284 by piston 298 being urged from the first to the second position by the fluid. Thereafter, the amount of force necessary to further insert piston shaft 182 a second predetermined distance Y-X within secondary-dampening chamber 256 of cylinder housing 258 gradually increases from an initial value B to an increased value B'. Since the nitrogen gas within secondary-dampening cylinder 290 is under greater pressure than the nitrogen gas within primary-dampening cylinder 284, a substantially greater force is required for piston shaft 182 to travel the predetermined distance Y-X than the initial predetermined distance X.

Figure 9:
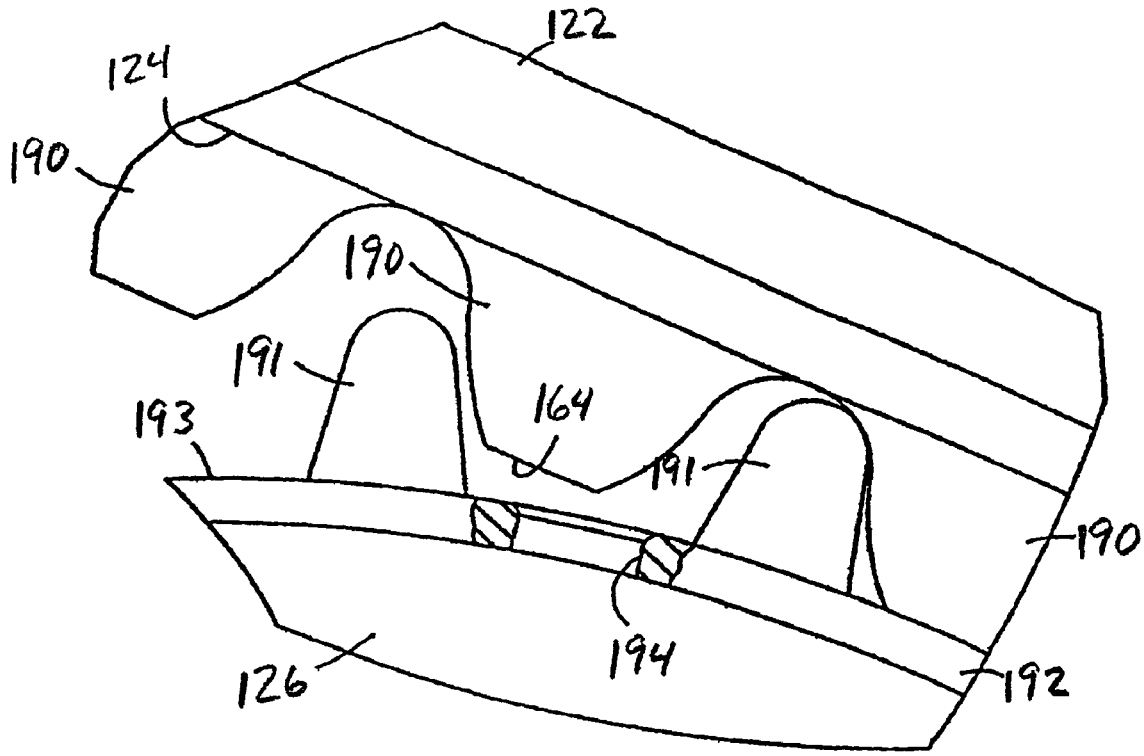
FIG. 9 is a side elevational view, partially-in-section, of a portion of the track apparatus of FIG. 7 showing engagement of the flexible track with the axle wheel in accordance with the invention.
Figure 10:
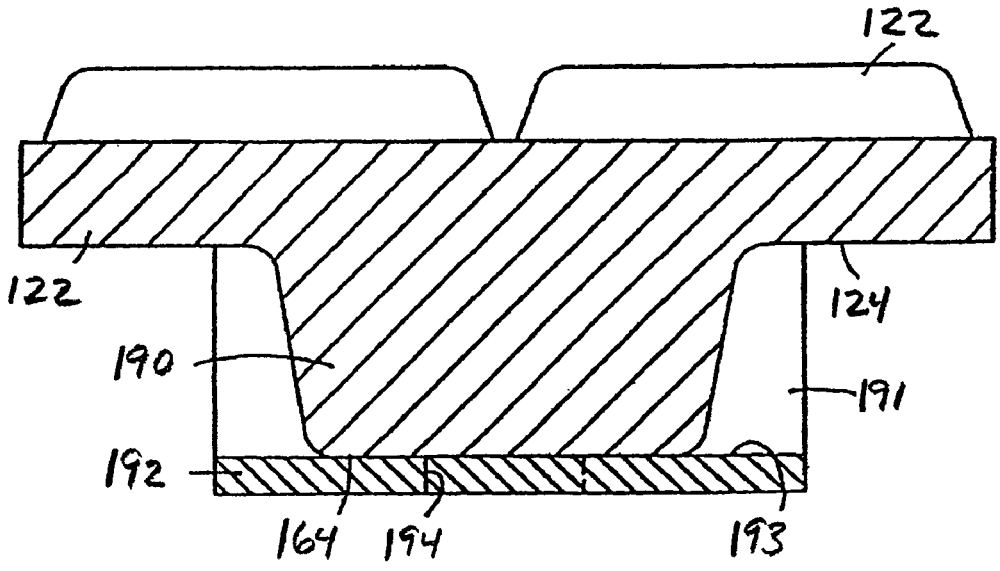
FIG. 10 is a cross sectional view, partially-in-section, of a portion of the track apparatus of FIG. 7 showing engagement of the flexible track with the axle wheel in accordance with the invention.

FIGS. 9 and 10 show that distal end surfaces 164 of track lugs 190 engage outer surface 129 of outer rim 192 of wheel in order that track lugs 190 are supported when driven by wheel 126. Such full engagement is seen in FIG. 10 and in the rightmost position of FIG. 9. Such full engagement, by which track 122 tends to function more like a driven belt and less like a driven chain, tends to minimize shearing forces on track lugs 190 and the possible twisting and turning of track lugs 190; hence, damage to track lugs 190 during operation of track apparatus 120 is significantly reduced, extending belt life.

Wheel 126 is free of side structure in positions which are both laterally adjacent to the lug-engagement surfaces that are between adjacent pairs of drive members 191 and radially beyond circumferential edge 198 of radially-extending portion 197 of wheel 126. As noted above, this tends to minimize or substantially eliminate the harmful torsional forces discussed above.

The following is a brief description of the engagement of flexible track 122 with other components of track apparatus 120: As flexible track 122 approaches leading idler wheels 130, track lugs 190 pass therebetween. In addition, the radially outer surfaces of leading idler wheels 130 engage the inner surface 124 of flexible track 122 and direct the lower length 121 of flexible track 122 into contact with a supporting surface such as a ground surface. As flexible track 133 continues to travel about wheel 126, track lugs 190 pass between the pairs of leading and trailing bogie wheels 150,160. The radially outer surfaces of bogie wheels 150,160 engage the inner surface 124 of flexible track 122 along its lower length 121 and insure contact of flexible track 122 with the ground surface along the lower length 121 of flexible track 122. Similarly, as flexible track 122 approaches trailing idler wheels 140, track lugs 190 on the inner surface 124 of flexible track 122 pass therebetween. The radially outer surfaces of idler wheels 140 engage the inner surface 124 of flexible track 122 and guide flexible track 122 onto wheel 126 to form a continuous loop. If wheel 126 is rotated in the opposite direction, trailing idler wheels 140 may function as leading idler wheels and leading idler wheels 130 may function as trailing idler wheels, all as known in the art.

Figure 11:
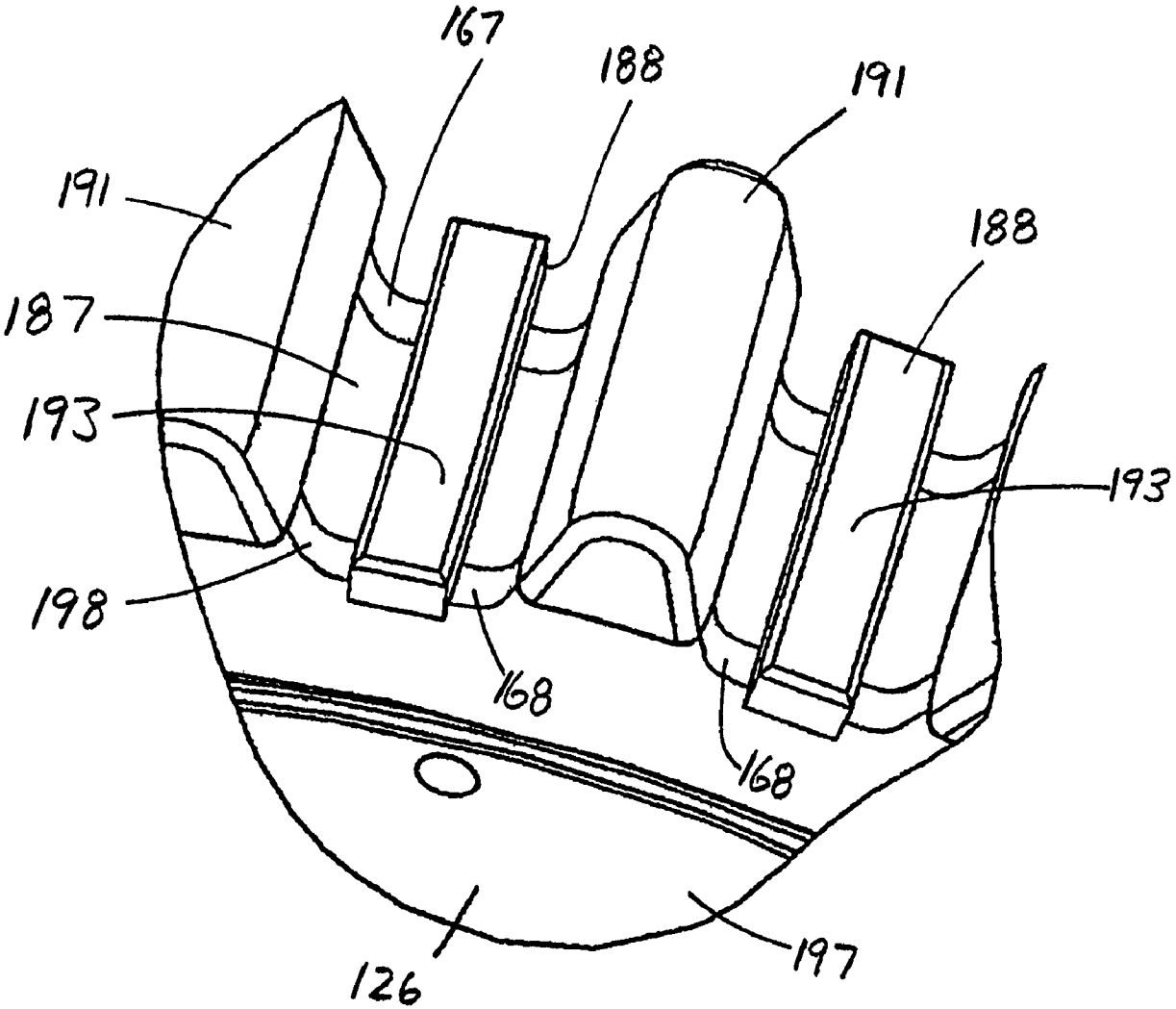
FIG. 11 is a fragmentary perspective view of the axle wheel of the track apparatus showing details of the peripheral portion of the wheel in accordance with the invention.
Figure 12:
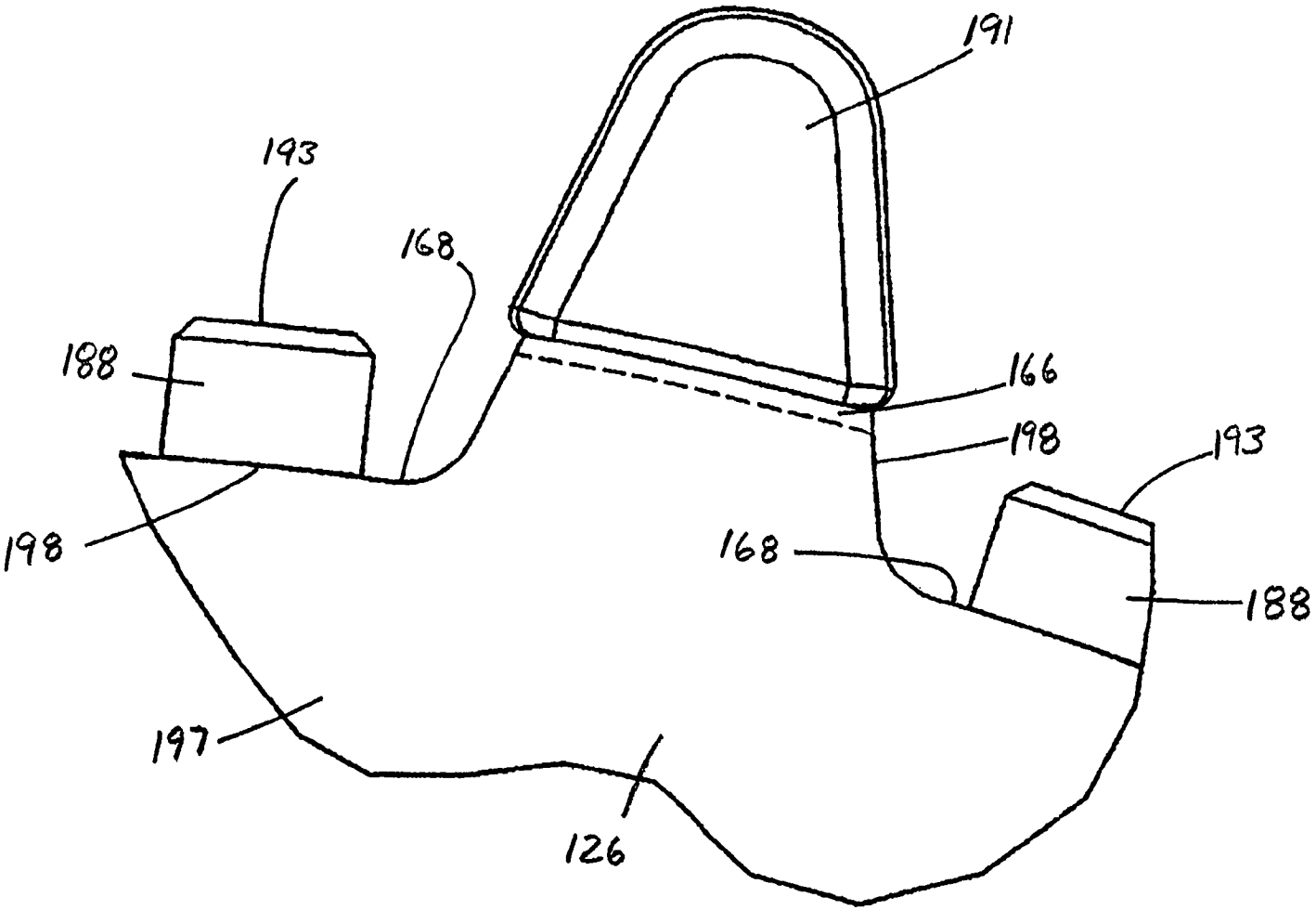
FIG. 12 is a fragmentary side elevation of the wheel of FIG. 11.

FIGS. 11 and 12 show an alternate wheel 126 which includes a radially-extending portion (or wall) 197, having inner and outer surfaces. Radially-extending portion 197 terminates in a circumferential edge 198, where a peripheral portion of wheel 126 is affixed thereto. The peripheral portion of wheel 126 includes a plurality of peripherally-spaced cross-members 188 which are affixed (welded) to recessed portions 168 of circumferential edge 198. Cross-members 188 form outwardly-facing lug-engaging surfaces 193, which are positioned for engagement with distal ends 164 of track lugs 191.

Spaced inwardly from radially-extending portion 197 and parallel thereto is a rigidity ring 187 which has an outward edge 167 which is parallel to and spaced from circumferential edge 198. Cross-members 188, in addition to being welded to recessed portions 168 of circumferential edge 198, are welded to corresponding recessed portions of rigidity ring 187. Cross-members 188 span the space between rigidity ring 187 and radially-extending portion 197, and such space facilitates removal of accumulated debris (e.g., mud) from between wheel 126 and flexible track 122 during operation. Cross-members 198, radially-extending portion 197 and rigidity ring 187 are positioned and dimensioned such that there are substantial open spaces for removal of mud and other debris. The substantial openness along the peripheral portion of wheel 126 is a significant advantage.

Circumferential edge 198, in addition to including recessed portions 168, has intervening extended portions 166, and outward edge 167 of rigidity ring 187 has a precisely parallel shape. In other words, outward edge 167 and circumferential edge 198 are formed with alternating aligned pairs of extended portions and aligned pairs of recessed portions. As can be seen, not only are cross-members 188 each affixed (welded) to a pair of corresponding recessed portions, but radially-projecting drive members 191 are each affixed (welded) to a pair of corresponding extended portions. As noted above, this facilitates manufacture of wheel 126.

As can be seen, wheel 126 is free of side structure. That is, wheel 126 is free of side structure in positions which are both laterally adjacent to cross-members 188 (i.e., laterally adjacent, not circumferentially adjacent), at positions between adjacent pairs of drive members 191 and radially beyond circumferential edge 198 of radially-extending portion 197 of wheel 126. As already noted, this serves to minimize or substantially eliminate harmful torsional forces.

Wheel 126 of track apparatus 120 fully engages distal end surface 164 of track lugs 190 in order that track lugs 190 are supported when driven by wheel 126. This full engagement of track 122 tends to minimize shearing forces on track lugs 190 and the possible twisting and turning of such lugs. Thus, damage to track lugs during operation of track apparatus 120 is reduced, significantly extending belt life.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

The invention claimed is:

1. A soil stabilizer for treating ground surface, comprising:

a stabilizer frame;

a rotor rotatably mounted with respect to the stabilizer frame, the rotor movable with respect to the ground surface such that the rotor may engage various depths of earth to cut and remove the earth;

a rotatable drive axle connected with respect to the stabilizer frame and adapted for moving the stabilizer frame and rotor across the ground; and a track apparatus operatively mounted on the rotatable axle surface through a track apparatus frame for positioning the track apparatus with respect to the stabilizer frame and rotor to provide improved contact of the rotor with the ground surface and improved traction of the soil stabilizer, the track apparatus including:

a continuous flexible track having an upper length and a ground-engaging lower length and including an inner surface;

a tensioner for maintaining tension on the continuous flexible track, the tensioner comprising a main-cylinder housing connected to the track apparatus frame, the main-cylinder housing extending along an axis for maintaining the rotor in engagement with the ground and reducing vibration and bounce of the stabilizer frame and rotor as the stabilizer is moved across the ground;

an axle wheel mountable to the rotatable drive axle for rotational movement therewith, the axle wheel engaging the inner surface of the continuous flexible track along the upper length to drive the continuous flexible track in response to rotation of the axle; and a leading idler arm having a leading idler wheel rotatably mounted on a leading idler axle and engaging the inner surface of the continuous flexible track, the leading idler axle defining a notch which allows the tensioner to extend, allowing the leading idler wheel to maintain contact of the continuous flexible track with the ground surface as the stabilizer is moved across the ground.

2. The soil stabilizer of claim 1 having two of the track apparatus axially aligned, each on an axle end.

3. The soil stabilizer of claim 2 wherein the rotatable drive axle having the track apparatus is a front axle, the soil stabilizer further including:

a rear rotatable axle connected with respect to the stabilizer frame;

a rear track apparatus operatively mounted on the rear rotatable axle, the rear track apparatus including:

a continuous flexible track having an upper length and a ground-engaging lower length and including an inner surface;

a rear axle wheel mountable to the rotatable rear axle for rotational movement therewith, the rear axle wheel engaging the inner surface of the flexible track along the upper length thereof; and a rear track apparatus frame for mounting the rear axle wheel.

4. The soil stabilizer of claim 2 further including a mixing chamber with a bottom surface movable into position engaging the ground surface such that the rotor lowered into contact with the earth passes through the bottom surface to pull soil into the chamber where the soil is treated, the mixing chamber having a rear exit for passing treated soil therethrough.

5. The soil stabilizer of claim 2 wherein each track apparatus includes leading and trailing idler wheels engaging the inner surface of the track and at least one bogie wheel engaging the inner surface of the track only in a middle portion of the lower length of the track, and wherein:

the track apparatus frame is of a uni-body construction such that it includes fixed-mounts in fixed relative positions, each fixed-mount defining an axis;

the axle wheel is rotatably mounted to one of the fixed-mounts and turns on the respective fixed-mount axis;

one of the idler wheels is rotatably mounted to one of the fixed-mounts and turns on the respective fixed-mount axis, the at least one bogie wheel is rotatably mounted to one of the fixed-mounts and turns on the respective fixed-mount axis, and an idler-mounting bracket pivotably mounted to another of the fixed-mounts and pivots on the respective fixed-mount axis, the bracket having an idler-mount defining an idler-mount axis at which the other idler wheel is rotatably mounted in variable positions with respect to the apparatus frame.

6. The soil stabilizer of claim 5 wherein the track apparatus frame includes a spindle hub for rotatably receiving the rotatable axle and defines a lateral recess receiving the axle wheel.

7. The soil stabilizer of claim 5 wherein:

the fixed-mounts include apertures for receiving axles therethrough;

the trailing idler wheel is rotatably mounted to one of the fixed-mounts; and the leading idler wheel is rotatably mounted to the idler-mount.

8. The soil stabilizer of claim 5 wherein the trailing idler wheel includes a pair of axially-aligned wheels and the leading idler wheel comprises a pair of axially-aligned wheels.

9. The soil stabilizer of claim 5 wherein the track apparatus further includes a leading idler assembly secured with respect to the track apparatus frame at one of the fixed mounts, the leading idler assembly including the leading idler wheel engaging the flexible track.

10. The soil stabilizer of claim 2 wherein each flexible track apparatus includes spaced lugs projecting from the inner surface, each lug terminating in a distal surface spaced inwardly from the main inner surface, and wherein the axle wheel comprises:

a central hub portion mountable on the axle for rotational movement therewith;

a radially-extending portion terminating in a circumferential edge; and a peripheral portion affixed to the circumferential edge and having outwardly-facing lug-engagement surfaces positioned for engagement with the distal surfaces of the track lugs.

11. The soil stabilizer of claim 10 wherein the peripheral portion includes an outer rim forming the outwardly-facing lug-engaging surfaces.

12. The soil stabilizer of claim 10 wherein each lug-engagement surface extends in an axial direction parallel to the drive axis such that each lug-engagement surface is a portion of a cylinder.

13. The soil stabilizer of claim 12 wherein the axle wheel is substantially free of side structure in positions which are laterally adjacent to the lug-engagement surfaces between adjacent pairs of the drive members and radially beyond the circumferential edge, whereby the track lugs are free to adjust their precise positions of engagement with the lug-engagement surfaces.

14. The soil stabilizer of claim 10 wherein the peripheral portion includes peripherally-spaced cross-members affixed to the circumferential edge and forming the outwardly-facing lug-engaging surfaces.

15. The soil stabilizer of claim 10 wherein the outwardly-facing lug-engagement surfaces are substantially planar.

16. The soil stabilizer of claim 10 wherein the axle wheel is substantially free of side structure in positions laterally adjacent to the lug-engagement surfaces and radially beyond the circumferential edge, whereby the track lugs are free to adjust their precise positions of engagement with the lug-engagement surfaces.

17. The soil stabilizer of claim 10 wherein:

the peripheral portion affixed to the circumferential edge has radially-projecting drive members defining lug-receiving gaps therebetween, the outwardly-facing lug-engagement surfaces are within the lug-receiving gaps in position for engagement with the distal surfaces of the track lugs, and the axle wheel is substantially free of side structure in positions which are laterally adjacent to the lug-engagement surfaces between adjacent pairs of the drive members and radially beyond the circumferential edge, whereby the track lugs are free to adjust their precise positions of engagement with the lug-engagement surfaces.

* * * * *